United States Patent [19]

Abdalla et al.

[11] 4,242,370

[45] Dec. 30, 1980

[54] METHOD OF MANUFACTURING THIN FILM ELECTROLUMINESCENT DEVICES

[76] Inventors: Mohamed I. Abdalla, 39, Rue de l'Amiral Mouchez, Paris, France, 75013; Jacques A. Thomas, 22, Avenue Victor Hugo, Bagneux, France, 92220

[21] Appl. No.: 27,597

[22] Filed: Apr. 6, 1979

[30] Foreign Application Priority Data

Mar. 17, 1978 [FR] France ..... 78 07807

[51] Int. Cl.[3] ..... B44D 1/18; B44D 1/16

[52] U.S. Cl. ..... 427/66; 428/70; 427/255.2; 427/64

[58] Field of Search ..... 427/66, 64, 70, 255.2; 118/6

[56] References Cited

U.S. PATENT DOCUMENTS

| | | | |
|---|---|---|---|
| B 381,709 | 1/1976 | Lipp | 427/70 |
| 2,917,442 | 12/1959 | Hanlet | 427/66 |
| 3,044,902 | 7/1962 | Thornton | 427/66 |
| 3,113,040 | 12/1963 | Winston | 427/70 |
| 3,889,016 | 6/1975 | Valsenko | 427/66 |
| 3,894,164 | 8/1975 | Dismukes | 427/70 |

*Primary Examiner*—Sam Silverberg

*Attorney, Agent, or Firm*—Abraham A. Saffitz

[57] ABSTRACT

Method of manufacturing thin film electroluminescent devices composed of a compound of zinc and sulphur, activated by a first metal activator consisting of copper and activated by a second metal consisting of copper manganese, excitable by direct and pulsed voltage. This method includes the steps of placing a substrate in an evacuated bell jar at the top portion thereof; placing in said bell jar first, second, third and fourth ovens respectively containing, in the form of elementary bodies, zinc, sulphur, the activator metal of copper and the activator metal of manganese, these ovens having apertures at the top portion thereof directed towards the substrate, for passage of the evapored elementary bodies; heating the substrate at a predetermined deposition temperature; simultaneously heating during a common period the ovens at respective first, second, third and fourth predetermined temperatures for causing the elementary bodies contained therein to be evaporated and deposited together on said substrate; heating the substrate at a predetermined recrystallization temperature and heating during an additional period the oven containing the element of group VI B alone at the recrystallization predetermined temperature.

2 Claims, 6 Drawing Figures

METHOD OF MANUFACTURING THIN FILM ELECTROLUMINESCENT DEVICES

BACKGROUND OF THE INVENTION

1. Field of the Invention

The invention relates, in general, to electroluminescent screens of the type that comprises a thin electroluminescent layer based on compounds of elements of zinc and sulphur, on a transparent support. More precisely, it relates to a process of manufacture of the electroluminescent layer, appliances for application of the process and the electroluminescent layers provided by the same process. Screens of this type have a sandwich structure and comprise, as an example:

- a support plate of transparent material (glass);
- a first electrode composed of a continuous layer of transparent and electrically conductive material ($SnO_2$ or $In_2O_3$ or a mixture of the two) deposited on the support;
- an electroluminescent layer deposited on the first electrode;
- a second electrode or counter-electrode composed of a continuous layer or of strips of electrically conductive material (aluminium) deposited on the electroluminescent layer.

The material or phosphor of which the electroluminescent layer is made is composed of zinc and sulphur. Zinc sulphide (ZnS) is the most commonly used. In order to obtain an acceptable rate of emission brightness, at least one doping element selected from copper metal and manganese metal must be incorporated in the form of an activator to the electroluminescent compound. Selection of doping elements provides a means of acting to a certain extent on the spectral composition of a light beam excited by application across the electrodes of an alternating or direct voltage.

Further, the functional properties depend to a very great extent on the structure of the electroluminescent layer which is itself determined by the preparation process.

The following parameters are particularly used to assess these processes:

(a) the luminance emission power defined by the ratio of the luminance to the excitation voltage;

(b) the ratio of the luminance to the width of pulses in the event of pulse excitation;

(c) the discrimination ratio defined as the ratio between luminance obtained by application of a voltage U, continuous or pulsed, and the luminance obtained by application of a voltage U/2;

(d) the lifetime which is defined as the time of operation under given conditions of excitation, at the end of which luminance only attains half its initial value.

Depending on the process of manufacture utilized, the phosphor electroluminescent layer may be made of phosphor grains dispersed in a transparent dielectric binding agent or may take the form of thin evaporated films. These latter may be excited by a high alternating voltage and this leads to good lifetimes or by a direct or pulsed voltage but with poor lifetimes.

2. Prior art

A known process of manufacturing a granular layer consists of spreading a suspension of a powder of a doped compound, agglomerated by a small quantity of dielectric binding agent, on a substrate which has previously been covered by a light transmissive, electrically conducting electrode. The binding agent may advantageously be a polymer resin. It has been strongly recommended, in order to obtain a very fine powder of homogeneous composition, that it should be prepared by co-precipitation from a solution containing the electroluminescent compound (ZnS) and the doping elements (Cu and Mn). In order to provide direct current operated electroluminescent devices, the surface of the grains is covered by diffusion with copper sulphide; it is also necessary, as in the other processes, to carry out an operation of forming of the layer by application of an unidirectional voltage for a certain time. The DC current supply required to obtain a suitable luminance after forming, that is to say better than ten foot lambert, is about 100 volts. Lifetimes of the order of 2000 hours can be reached with these devices.

A process of high-frequency sputtering has also been proposed to provide a continuous layer. This process consists of placing the substrate on an electrode in an evacuated bell jar in the vicinity of further target electrodes made of the bodies constituting the electroluminescent layer to be formed and applying a high frequency sufficiently high voltage between the substrate electrode and the target electrodes to generate plasmas. The electroluminescent layer obtained is fragile and it has been established that a resistant deposit of cermet (nickel-silica or aluminium-silica) must be applied to the said layer to limit the operating current and to thus increase the breakdown voltage. In any case, the lifetime of such layers, excited by pulses of medium voltage (greater than 250 V), would not appear to exceed a few hours.

According to another process of the prior art, a method of manufacturing a thin film electroluminescent device, wherein the said thin film of electroluminescent material is composed of a matrix material consisting of one or more of the compounds zinc or cadmium sulphide or selenide, activated by at least two activator metals and at least one halogen so as to be excitable to luminescence by the application of a voltage between electrodes, includes the steps of first evaporating the matrix material simultaneously with at least one of the required activator metals in free or combined form and causing the evaporated substances to be deposited together, in the desired relative proportions and in the form of a thin film on a light-transmissive, electrically conducting substrate constituting a support for the said film and one of the electrodes of the device, then raising the temperature of the substrate and film and exposing the film to a gaseous mixture consisting of or containing the remainder of the required activator elements, including one or more halogens, in the vapor state, the temperature of the substrate, the vapor pressure of the said gaseous mixture, and the time of exposure of the film to said mixture being such as to cause the desired amounts of said elements to be deposited upon and to diffuse into said film, and recrystallisation of the film to take place, and then depositing a metal layer upon the film by evaporation to form the second electrode of the device.

The electroluminescent layers of the prior art have at least one of the following disadvantages:

- excitation is difficult with DC current supply;
- sensitivity is weak, in other words luminance has to be excited by a voltage of value of at least some tens of volts and this significantly reduces the possibilities of providing power to the screen through common types of semiconductor devices.

The main reason for these disadvantages seems to be the lack of homogenity of their composition and of their internal structure. Thus, for instance, when the layer is built up by vaporization in vacuum of a powder containing one of the basic compounds, the high temperature required which is at least 1,200° C. in the case of zinc sulphide and more if it is desired to hasten the rate of deposit, is likely to cause partial decomposition of the said compound; the result is that the composition of the layer obtained is not stoechiometric. Further, when the matrix material contains basic compounds and activator metals, it is virtually impossible to give the said matrix a composition which provides optimization of both the rate of deposit of the basic compounds and the rate of deposit of the activator metals.

The process of the invention is simple, only requires equipment of relatively low cost and provides electroluminescent thin film devices which have satisfactory lifetimes and high sensitivity, whether operated by DC current supply or by pulsed current over a wide range of pulse widths. Further, screens may be made with completely reproduceable characteristics and with a large surface area, viz 100 $cm^2$.

SUMMARY OF THE INVENTION

The process of the invention consists basically and firstly of placing the light-transmissive, electrically conducting substrate of the electroluminescent layer in a chamber under vacuum, opposite a number of evaporation ovens each of which contains an element that forms part of the said electroluminescent layer and delivers a vapor of the said element through an opening in its top and, secondly, of allotting a given rate of heating to each of the said ovens so that optimal rate of evaporation can be provided for each component.

Consequently, the appliances required for implementation of the said process comprise a number of evaporation ovens provided with separate heating facilities and of which each is provided with a vapor orifice at its top and substrate supports opposite the orifices of the said ovens arranged so that the said substrate receives the vapor delivered by each oven, in a chamber fitted with a vacuum facility.

The following is advantageous:

- in order to favour adherence of the electroluminescent layer on the substrate and texturization of the layer, the support is fitted with facilities for heating the said substrate that enable it to be held at a suitable temperature while the deposit is being applied and then, at the end of depositing process, for heating the substrate in order to homogenize by recrystallizing the microstructure of the layer;
- in order to provide an additional effect of cryopumping, the ovens are surrounded by a double vapor-trap wall through which a cooling fluid passes;
- in order to reduce heat radiation between ovens, each oven is surrounded by a heat screen;
- in order to delineate the geometry of the vapor stream of each component, each oven is surrounded by a diaphragm containing a central opening which provides the passage for the vapor and is arranged and orientated so that the axes of the vapor streams converge towards the substrate.

BRIEF DESCRIPTION OF THE DRAWINGS

Other objects and advantages of the process in accordance with the invention, used for the manufacturing of thin film electroluminescent devices in which the phosphor film consists of zinc sulphide activated by manganese and copper, will becomed apparent from the following detailed description with reference to the accompanying diagrammatic drawings, in which.

DESCRIPTION OF THE PREFERRED EMBODIMENTS

Figure 1:
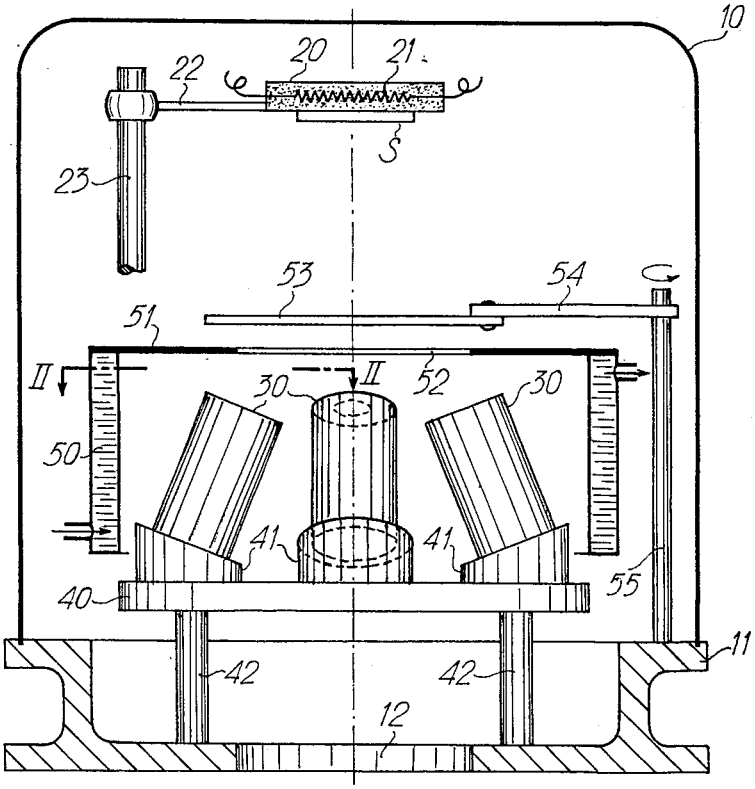
FIG. 1 is a vertical cross-sectional view of an appliance according to the invention.
Figure 2:
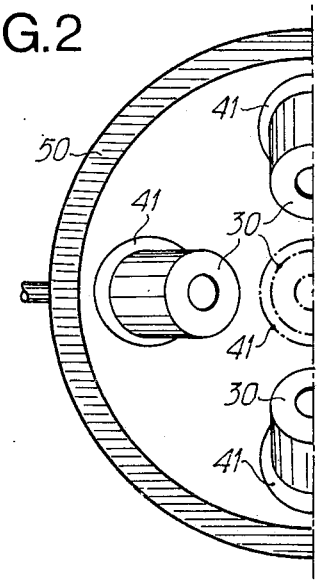
FIG. 2 is a horizontal cross-sectional view of the same appliance passing through line II—II of FIG. 1.

Referring first to FIGS. 1 and 2, these figures only illustrate the basic lay-out of the appliance, excluding accessory arrangements or ancillaries such as sealing gaskets, assembly components, sealed passages for wires or ductings, etc.

The sealed chamber of the appliance is composed of a bell jar 10 of which the rim rests on a base plate 11, provided with an aperture 12 for connection to a vacuum pump. The bell jar is evacuated to a pressure of about $5\times10^{-6}$ torr before the operations of evaporation and to a pressure of about $10^{-4}$ torr during these operations. The substrate support is composed of a heater 20 under which substrate S is secured. Heater 20 is heated by an electric resistor 21. The heater is held at the top of bell jar 10 by means of heater-holding arm 22 and column 23 secured to base plate 11.

In order to separately evaporate the various elements destined to constitute the thin film, ovens 30 are held on plate 40 by means of pedestals 41. Plate 40 is secured to bell jar base 11 by columns 42. Each oven is destined to contain and to evaporate one element and one element only. For exemple, in order to deposit a layer of zinc sulphide doped with manganese and copper, four ovens 30 must be placed on plate 40. Whatever the number of ovens, they should preferably be placed symmetrically about an axis perpendicular to the center of substrate S; moreover, one of the ovens may be installed along this axis. It is also recommended that the ovens be orientated by means of sloping pedestals so that the axes of the vapor streams that they deliver converge towards the central region of the substrate.

Oven 30 are surrounded by a cooling sleeve 50 through which, for example, a current of liquid nitrogen passes. Sleeve 50 is covered by screen 51 in which a central hole 52 is cut to provide passage for the vapor released by ovens 30. Sleeve 50 and screen 51 trap the vapor which circulates around the ovens. Opening 52 may be masked by shutter 53 which is supported from a shaft 55 through an arm 54 and is arranged to be swung into operative and rest position to expose the substrate to and shield it from the sources. Masking shutter 53 is made advantageously of tantalum, a refractory metal which has little reaction under the conditions of use.

Figure 3:
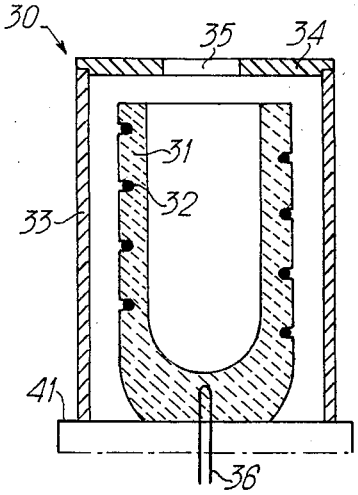
FIG. 3 is a vertical cross-sectional view of one of the ovens used in the said appliance.

Reference is now made to FIG. 3 which represents one of the evaporation ovens 30 shown in FIGS. 1 and 2. This oven is composed of crucible 31 supported on a pedestal 41 and has a heating element 32 in the form of a tungsten wire wound round it. The crucible is surrounded by cylindrical heat screen 33 covered by diaphragm 34. The crucible is made of a refractory and electrically insulating material which has no chemical reaction with the elements that it may contain and the vapors that it may release. Boron nitride, for example, is advantageously suitable from all points of view. Resistance 32 is made of tantalum as is screen 33. The function of the sreen is to limit heat exchange by radiation from one oven to the others. Diaphragm 34, also made of tantalum, has a central aperture 35 which provides passage for the emitted vapor. The cross-section of the start of the vapor stream is thus restricted and clearly delineated, which provides a uniform rate of deposit of the whole surface of substrate S. An electric thermocouple 36, placed in the bottom portion of the crucible, gives a measure of the temperature in the oven.

When the electroluminescent layer has been built up, evaporation is stopped by switching off the power supply to resistance 32 of each oven. Because of the thermal inertia of the ovens and, particularly, of crucibles 31, the substances that they contain may continue to evaporate for a few moments. The vapors that are then emitted may be prevented from reaching the substrate by placing the masking shutter 53 in front of opening 52. However, this does not prevent, after the sulphide layer is deposited, enrichment of the atmosphere in sulphur in order to carry out recrystallisation as described below, because of the space between plate 52 and shutter 53.

In industrial applications at least some of the resistor-heated ovens may be replaced by electron-gun ovens which would provide for rapid starting and stopping of evaporation of the relevant elements.

The operation of the apparatus of FIGS. 1–3 will now be disclosed in the case of the manufacture of a thin film electroluminescent device in which the basic compound is zinc sulphide and the activator metals are copper and manganese.

Substrate S, made of glass, for example of borosilicate glass of the kind sold under the Registered Trademark "Pyrex," already covered with a transparent conducting coating of $SnO_2$ or $In_2O_3$ or a mixture of the two and destined to constitute the transparent electrode, is secured under heater 20 with the said electrode in front of ovens 30. Ovens 30 have been charged with zinc, sulphur, copper and manganese respectively.

Bell jar 10 is put in place and the pump is started to provide vacuum of about $5.10^{-6}$ torr.

The operation of evaporation and of deposition which lasts 20 minutes, is carried out at the following temperatures:

substrate S (heated by heater 30): 400° C. approx.
oven crucible containing zinc: 550° C.
oven crucible containing sulphur: 100° to 200° C.
oven crucible containing manganese: 970° C.
oven crucible containing copper: 1,010° C. for 15 to 17 minutes and then at 1,080° C. until the end of the 20 minutes period.

When deposit is terminated, shutter 53 is put in place and all the ovens are stopped excepting the oven containing the sulphur while substrate S is raised to a temperature higher than 300° C. This operation of recrystallization in a sulphur-rich atmosphere is continued for about 60 minutes.

The coated substrate is removed from the appliance. A metal electrode is then applied to the layer in accordance with a known technique and the screen thus made is encapsulated according to an also known technique in order to protect the said layer against exterior polluting agents.

It is known that a just manufactured electroluminescent screen only starts to emit light after it has been submitted to a so-called forming phase with a DC current. At the start of the forming phase, the voltage-current characteristic of the screen is virtually ohmic. At the end of this phase, it practically corresponds to the characteristic of a diode and the screen effectively becomes electroluminescent. The light emitted by a screen built in accordance with the example of application of the process of the invention described above, is of yellow-orange color, corresponding to a wavelength of about 5,850 angstroems.

Figure 4:
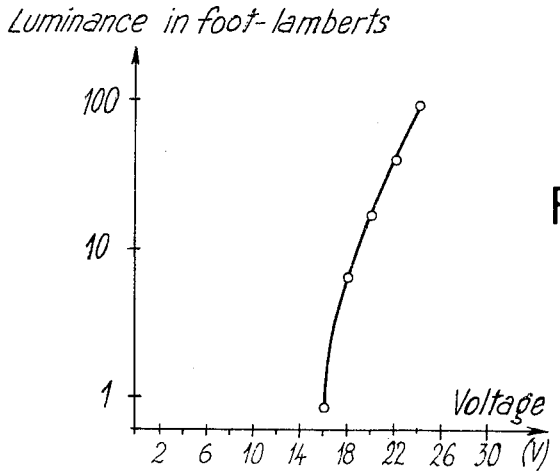
FIGS. 4, 5 and 6 are characteristic curves that illustrate the performances of a screen of which the electroluminescent layer has been built up in compliance with the process of the invention.

The semi-logarithmic diagram of FIG. 4 illustrates the luminance characteristic in foot-lambert (fL) of the said screen as a function of an applied DC voltage, expressed in volts. The value of luminance obtained for a voltage of 25 volts is high (100 fL) and corresponds to a quite high sensitivity. The curve slopes steeply, that is to say that the corresponding values of the discrimination ratio are high. Thus, for example, the slope of the tangent to the curve at about 10 fL corresponds to a discrimination ratio of about $10^7$. This excellent figure means that initial luminance may easily be sustained by means of a very slight increase of voltage, at the end of a long period of operation. As will be seen below, referring to FIG. 6, the lifetime obtained is satisfactory and the invention if able to provide screens with an adequate time of operation.

Figure 5:
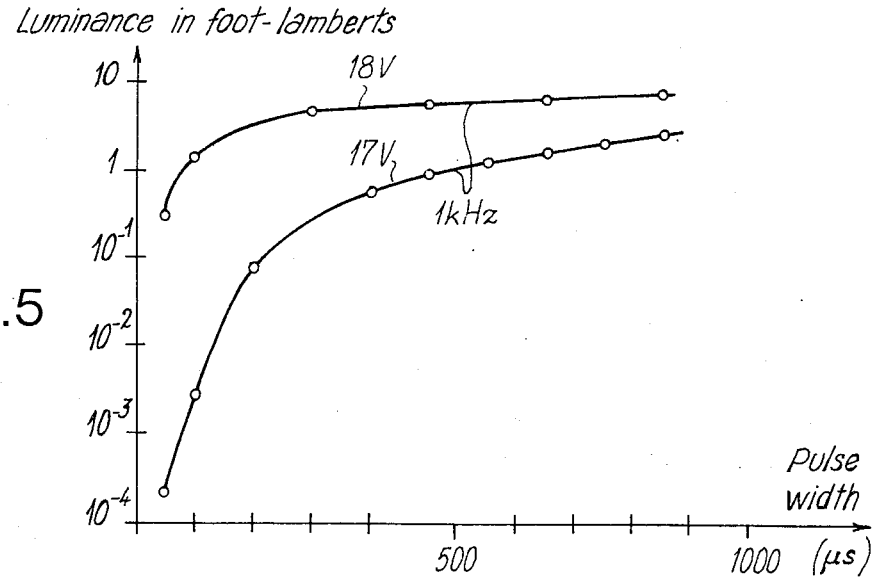

Consideration is now given to FIG. 5 which relates to performances of the screen when powered by a pulse voltage. These two curves show the variation of luminance as a function of the width of pulses applied at a recurrent frequency of 1 kHz. The lower curve corresponds to a peak voltage of pulses of 17 volts and the lower curve to a peak voltage of 18 volts. It may be noted that the width of pulses has a very noticeable effect on luminance which provides a means of obtaining a wide range of scale of grey by pulse width modulation.

Tests have, furthermore, shown that screens made in accordance with the invention are very visible under fairly strong ambient lighting (2,500 foot candles) when luminance is 10 fL. The contrast measured under these conditions is about 3/1 which obviates use of excessively high supply voltages which might shorten lifetime. This may also be provided by simple modulation of amplitude within a narrow range, because of the high discrimination ratio.

Figure 6:
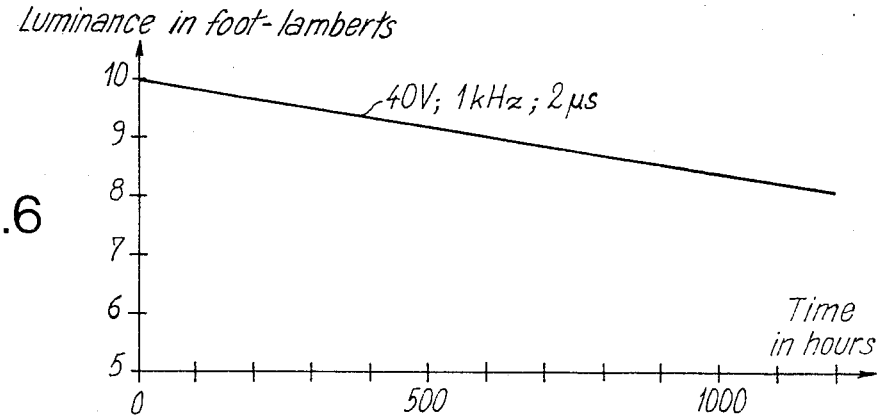

Finally, FIG. 6 is a diagram that relates to lifetime. A screen when made in accordance with the invention is fed by 40 V pulses, the width of pulses being 2 microseconds and their recurrent frequency 1 kHz (operative-inoperative time ratio=0.2%). It may be seen that luminance passes from 10 fL at start of operation to 8 fL after 1,200 hours which indicates an acceptable lifetime.

These test results show that screens made in accordance with the invention:

are able to operate under continuous or pulsed excitation voltage of low value;
have a long lifetime;
have a high discrimination factor;
are visible under relatively strong ambient lighting;
are able to create images with good contrast.

These screens therefore possess a set of advantages which are not possessed, to a varying degree, by screens manufactured by processes based on the previous state of the art.

With regard to the appliance covered by the invention, it is easy to control because operating parameters (times and temperatures) of each oven and of the heater of the substrate support may be set independently from each other. In order to control operation, action may be taken on the powers of the heating currents while taking care to maintain the readings of temperatures given by the thermocouples of the ovens and of the heater within set limits. More simply, when a manufacturing process is correctly adjusted, it is sufficient to only control one parameter, the voltage supply.

With regard to the composition of the electroluminscent layers deposited, one example only has been taken which concerns a layer of zinc sulphide doped with copper and manganese. The process of the invention is also suitable for production of electroluminescent layers based on compounds having at least one element of group II B and at least one element of group VI B of the periodic table, doped with Cu and Mn.

The heating temperatures of the ovens are approximate values which can accept slight variations of say 2% except when a larger range is defined (100°-200° C. for the sulphur oven; 1010°-1180° C. for the copper oven).

We claim:

1. A method of manufacturing a zinc sulfide thin film electroluminescent sandwich device activated by copper metal and by manganese metal comprising:

placing a glass substrate in a bell jar at a top portion thereof;

said glass substrate having an electrically conducting coating;

placing an electrical heater over said substrate in said bell jar;

placing first, second, third and fourth ovens holding elemental zinc, sulpher, manganese and copper respectively in said bell jar below said substrate and at a lower portion of said bell jar;

each said first, second, third and fourth ovens being provided with apertures at each top portion to direct vapors from each oven to said substrate above;

each said oven being provided with heating means to raise the temperature to vaporization of the elements therein and with cooling means to lower the temperature and thereby permit separate evaporation of the elements in the bell jar for deposition on said substrate under evacuation;

a plate supporting said four ovens sysmeterically about a central axis which is perpendicular to the center of the substrate;

evacuating means to evacuate the bell jar and its contents under pumping vacuum down to $5\times10^{-6}$ torr;

heating said substrate by means of said heater to a temperature of approximately 400° C.;

heating said oven containing zinc to about 550° C.;

heating said oven containing sulphur from about 100° C.; to 200° C.;

heating said oven contain-ng manganese to about 970° C.;

heating said oven containing copper to about 1010° C. for about ⅔ of the heating time and then up to about 1080° C. for the remaining time;

the foregoing heating steps being conducted simultaneously for a time of about 20 minutes under the aforesaid vacuum pumping;

stopping all vaporization except that from the sulphur to provide a sulphur rich atmosphere in said bell jar and oven to permit recrystallization of the zinc sulfide film deposited on said substrate; and maintaining the substrate in the sulphur rich atmospher for about 60 minutes after which the coated substrate is removed for attachment of a counter-electrode.

2. A method as claimed in claim 1 wherein said ovens are tilted toward said center axis by means of pedestals.

* * * * *